United States Patent [10]

Saintonge

[11] 4,052,837

[45] Oct. 11, 1977

[54] MULTIPLE POUCH BAGGING APPARATUS

[76] Inventor: Jerome Saintonge, 100 Cote Vertu, Apt. 907, St. Laurent, Quebec, Canada, H4N 1C7

[21] Appl. No.: 722,377

[22] Filed: Sept. 13, 1976

[51] Int. Cl.[2] ..... B65B 57/10; B65B 35/30

[52] U.S. Cl. ..... 53/62; 53/159; 53/189; 53/247

[58] Field of Search ..... 53/62, 61, 159, 189, 53/247

[56] References Cited

U.S. PATENT DOCUMENTS

| | | | |
|---|---|---|---|
| 3,513,624 | 5/1970 | Adcox | 53/62 |
| 3,715,857 | 2/1973 | Fronczak | 53/62 |

*Primary Examiner*—Travis S. McGehee

*Attorney, Agent, or Firm*—Alan Swabey & Co.

[57] ABSTRACT

The apparatus includes a continuously rotating member having groups of chutes located on the rotating member about the periphery and a plurality of conveyor discharge devices extend tangentially from the periphery of the rotatable member such that the discharge conveyors are adapted to drop a predetermined number of pouches into a group of chutes as the group passes underneath the discharge member.

7 Claims, 8 Drawing Figures

MULTIPLE POUCH BAGGING APPARATUS

BACKGROUND OF THE INVENTION

1. Field of the Invention

The present invention relates to an apparatus for supplying a plurality of liquid filled pouches into an outer flexible bag or container.

2. Description of the Prior Art

Many dairies today are using flexible quart size polyethylene pouches for packaging milk. In the actual distribution of these pouches, they must be supplied in an outer bag in pairs, in three's or even in four's.

It has proved to be a problem to efficiently handle these flexible liquid containing pouches and to place the pouches in the larger flexible bags. Developments in apparatus for handling such flexible liquid filled pouches and placing them in outer flexible bags are illustrated in U.S. Pat. No. 3,698,153, issued Oct. 17, 1972, A. B. Lieberman, inventor, and U.S. Pat. No. 3,778,972, issued Dec. 18, 1973, A. Chlipalski, inventor. However, neither of these patents describes an apparatus which can handle in a high speed manner the packaging of such pouches. Each apparatus is adapted for in-line bagging, and succeeding pouches being fed into the apparatus must be halted while a predetermined number of pouches are being discharged from a chute mechanism into an outer bag provided immediately below the chute mechanism. While this mechanism is operating, of course, the feeding conveyor must be stopped and started once the operation is finished and the chute is in condition to receive a new series of pouches.

SUMMARY OF THE INVENTION

It is an aim of the present invention to provide an apparatus for economical high-speed handling of liquid filled pouches and packaging such pouches by placing them into an outer flexible bag without perceptibly slowing the pouch filling production.

An apparatus in accordance with the present invention comprises a frame, at least one feed conveyor for advancing liquid filled pouches, a rotary chute assembly having a plurality of chute groups with each chute group including numbers of adjacent vertically extending chute sections corresponding to the number of pouches to be provided in a bag, each chute group including an outer bag holding station below the chute group, and means for opening said outer bag to receive a number of pouches from the particular chute group, each chute group and bag holding assembly being adapted to rotate about a circular locus passing under the discharge of the feed conveyor and cooperating means causing the feed conveyor to advance when there is a predetermined number of pouches on the feed conveyor and when there is a chute group passing below the discharge of the feed conveyor so as to receive the number of pouches being fed by the feed conveyor.

In a further more specific embodiment of the present invention, there is provided a plurality of feed conveyors for feeding the pouches to the rotary chute assembly.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
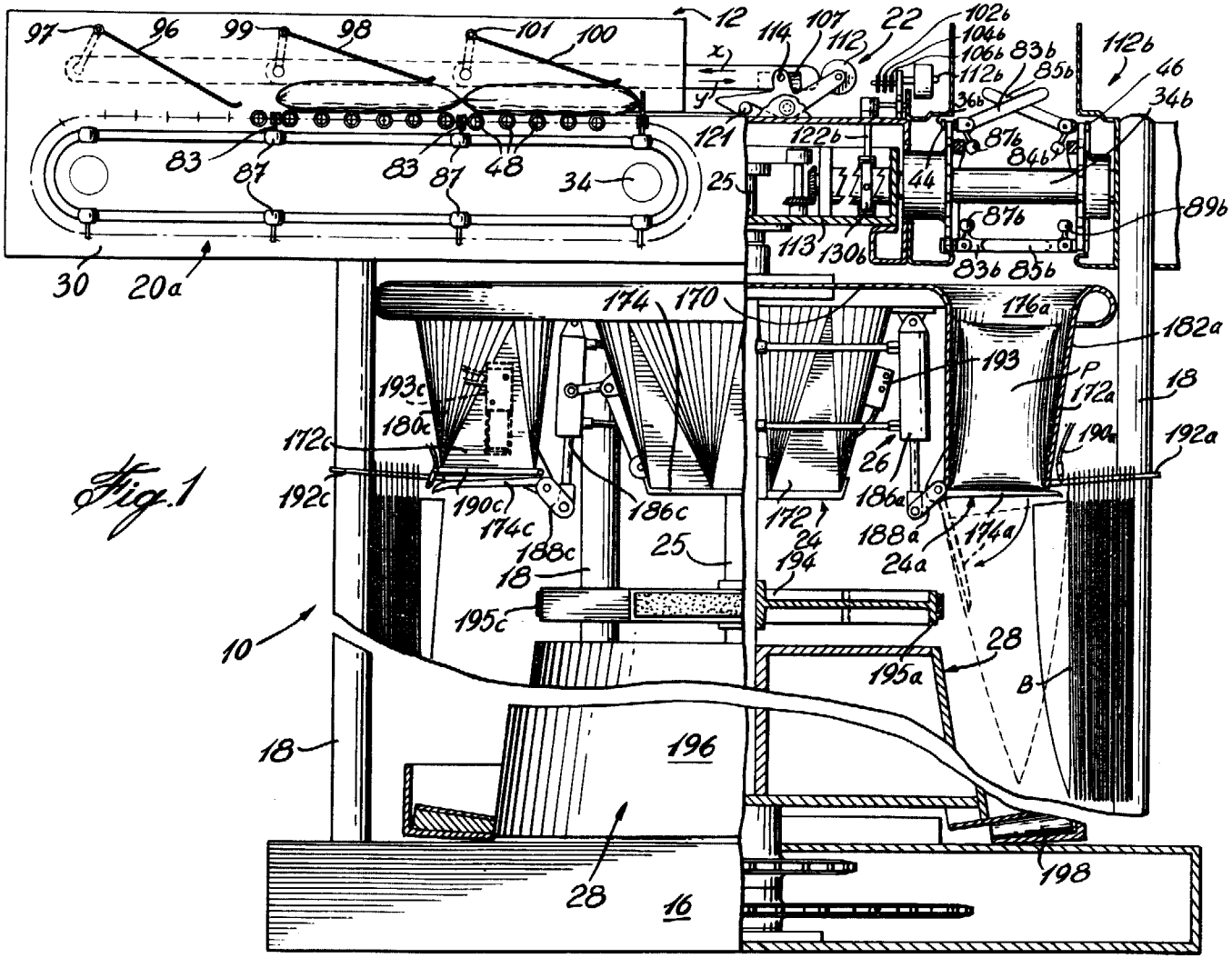
FIG. 1 is a vertical side elevation, partly in cross-section, of a bagging apparatus in accordance with the present invention.

Referring now to the drawings, especially to FIG. 1, there is shown a typical bagging machine 10 having four filling stations 12, 12*b*, 12*c* and 12*d* (only stations 12 and 12*b* are shown). Each filling station is mounted on a base 16 and supported by uprights 18. Each filling station 12, 12*b*, 12*c* and 12*d* includes a conveyor 20 and a conveyor actuating assembly 22. A rotary member 21 mounts four groups of chute assemblies 22, 22*b*, 22*c* and 22*d* as well as corresponding bag assemblies 26*a*, 26*b*, 26*c* and 26*d*. The chute assemblies are arranged so they are mounted peripherally on the rotary member 21 and pass under each fixed filling assembly 12, 12*b*, 12*c* and 12*d*.

Each bag filling assembly includes a housing 30 about a frame 32. The frame 32 mounts a drive shaft 34 at the discharge end thereof, and the drive shaft includes a pair of sprocket wheels 36. The other end of the conveyor includes idler sprocket 50, and conveyor claims 44 and 46 pass over the driven sprockets 36 and the idler sprockets 50. A plurality of freely rotating conveyor rollers 48 extend between the chains 44 and 46.

Figure 2:
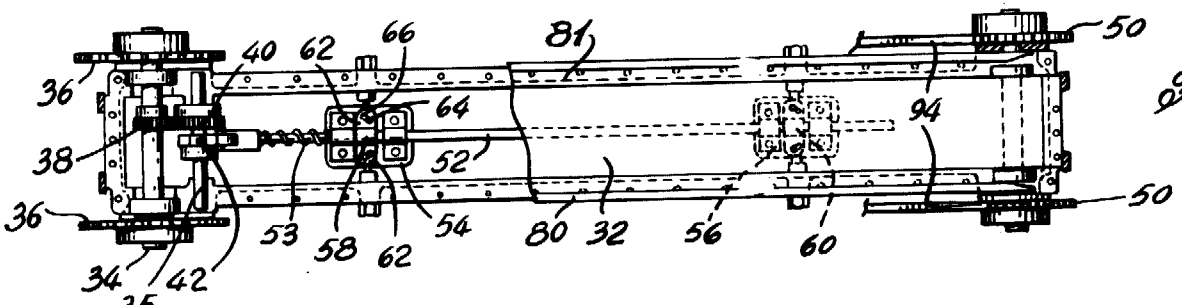
FIG. 2 is a top plan view, partly in cross-section, of a detail shown in FIG. 1.
Figure 3:
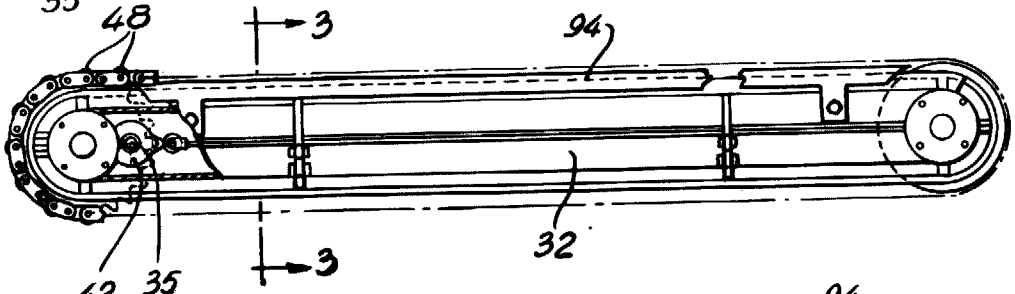
FIG. 3 is a side elevation, partly in cross-section, of a detail shown in FIG. 2.
Figure 4:
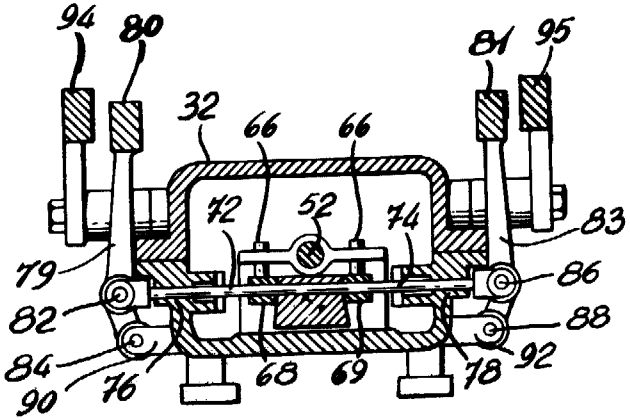
FIG. 4 is a vertical cross-section taken through line 4—4 of FIG. 3.
Figure 5:
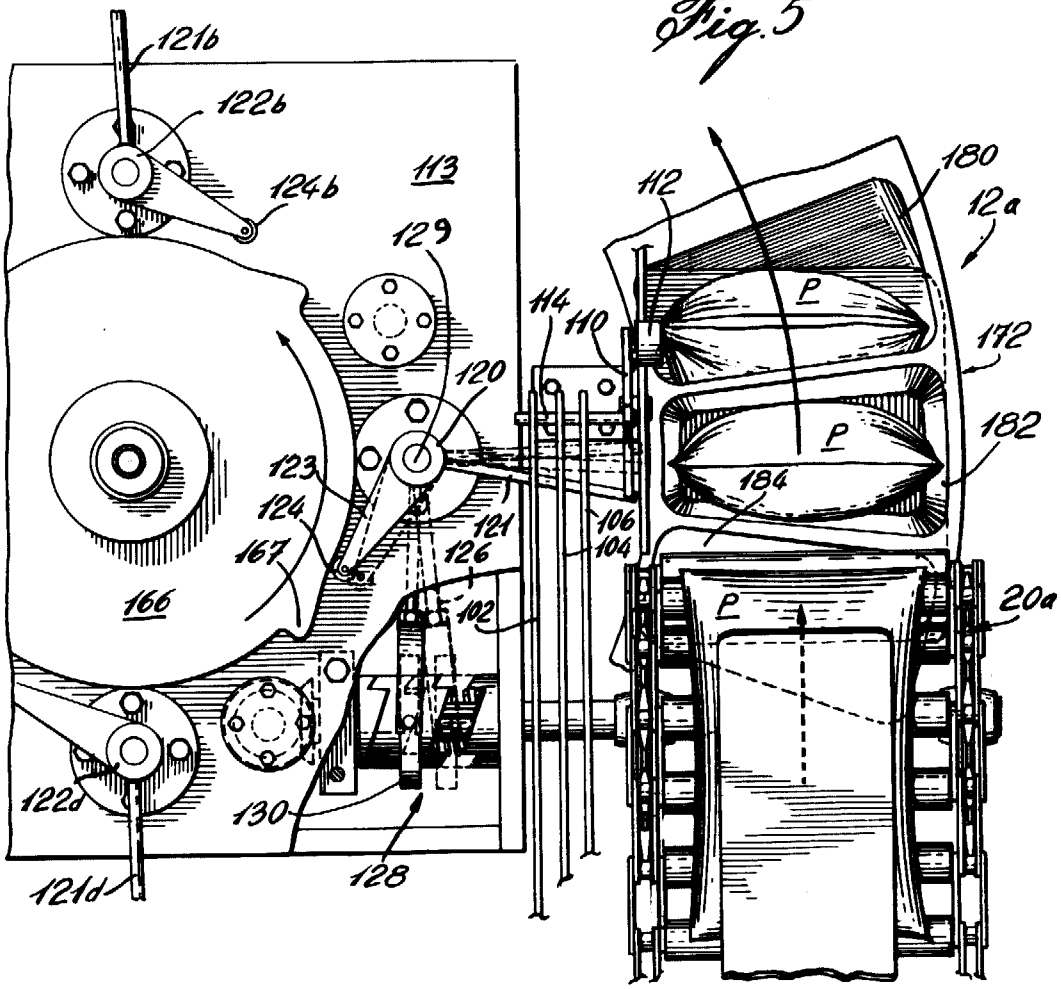
FIG. 5 is a top plan view of a portion of the apparatus.

Referring to FIGS. 2 and 3, there is a gear 38 mounted to the drive shaft 34 which in turn engages a gear wheel 40 mounted on a shaft 35 journalled to the frame 32. The ratio of gear 38 to 40 is 1½:1. The shaft 35 also mounts a fixed cam wheel 42. The cam wheel 42 is meant to engage a spring loaded sliding rod 52 which in turn passes through brackets 54 and 56. The rod 52 also mounts fixed collars 58 and 60 respectively, and each collar includes laterally extending wings 62. In each of the wings of each collar 58 and 60, there is provided angled slots as shown in FIG. 2, which pass guide pins 66. Each guide pin 66, as shown in FIG. 4, is connected to a fixed collar 68 and 69 respectively on sliding rods 72 and 74 passing through bearings 76 and 78 respectively. Each rod 72 and 74 is connected to arms 79 and 83 mounting the guide rails 80 and 81 respectively. The connections of these sliding rods 72 and 74 to the respective arms 79 and 83 are through pivot shafts 82 and 86. The lower ends of the arms 79 and 83 are pivotally connected at 84 and 88 respectively to projections 90 and 92 from the frame 32.

As shown in FIG. 1, there are provided a plurality of bell crank arms 83 and 85 which are pivotally mounted to the respective conveyor chains 44 and 46 and which are spaced apart longitudinally of the conveyor approximately the length of a pouch. The bell crank arms 83 and 85 are adapted to be in a position where they extend in the plane of the conveyor rollers 48 where they can be pivoted upwards as shown in FIG. 1 whereby they project above the plane of the roller conveyor and are adapted to engage the individual pouches. The pivoting of the bell crank arms 83 and 85 is caused by the inward and outward movement of the guide rails 80 and 81. The cam wheel 42, when the conveyor is in a stopped condition, will be in a position such that the cam presses the rod 52 against the urging of spring 53 thereby moving the collars 58 and 60 respectively, forcing the pins 66 to follow the angled slots thereby to be pushed outwardly from the rod 52.

The rods 72 and 74 will thus be extended outwardly from the center shown in FIG. 4, thereby holding the guide rods 80 and 81 in a position spaced apart from each other such that the rollers 87 and 89 on bell crank arms 83 and 85 will force the arms 83 and 85 to lie in the plane of the conveyor. The guide rails 80 and 81 will be so formed in the area of the discharge that the arms will extend above the plane of the conveyor when the conveyor is in a stopped position and the other arms are below the plane of the conveyor. At this time, any milk pouches which are advanced on the conveyor 20 will be allowed to accumulate with the leading pouch against the arms 83 and 85 of the set of arms immediately above the drive shaft 34.

The chains 44 and 46 are allowed to travel over tracks 94 and 95 fixed to either side of the frame 32.

Three gates 96, 98 and 100 are each pivotally connected to the housing 30 of the conveyor at pivot points 97, 99 and 101 respectively. Each gate member is pivotally connected to sliding bars 102, 104 and 106, each bar having a notch 103, 105 and 107 respectively, at the other end thereof. When the conveyor is at rest and no pouches are on the conveyor, all of the gates 96, 98 and 100 would be in a clockwise down position, and the notches would be pulled in a direction X shown in FIG. 1, thereby locking the finger 114 of control lever 110.

Journalled to the base 16 is a driven main shaft 25. The shaft 25 is supported at the top thereof by means of a housing 113 which also houses the various clutch mechanisms adapted to drive the conveyors 20.

Figure 7:
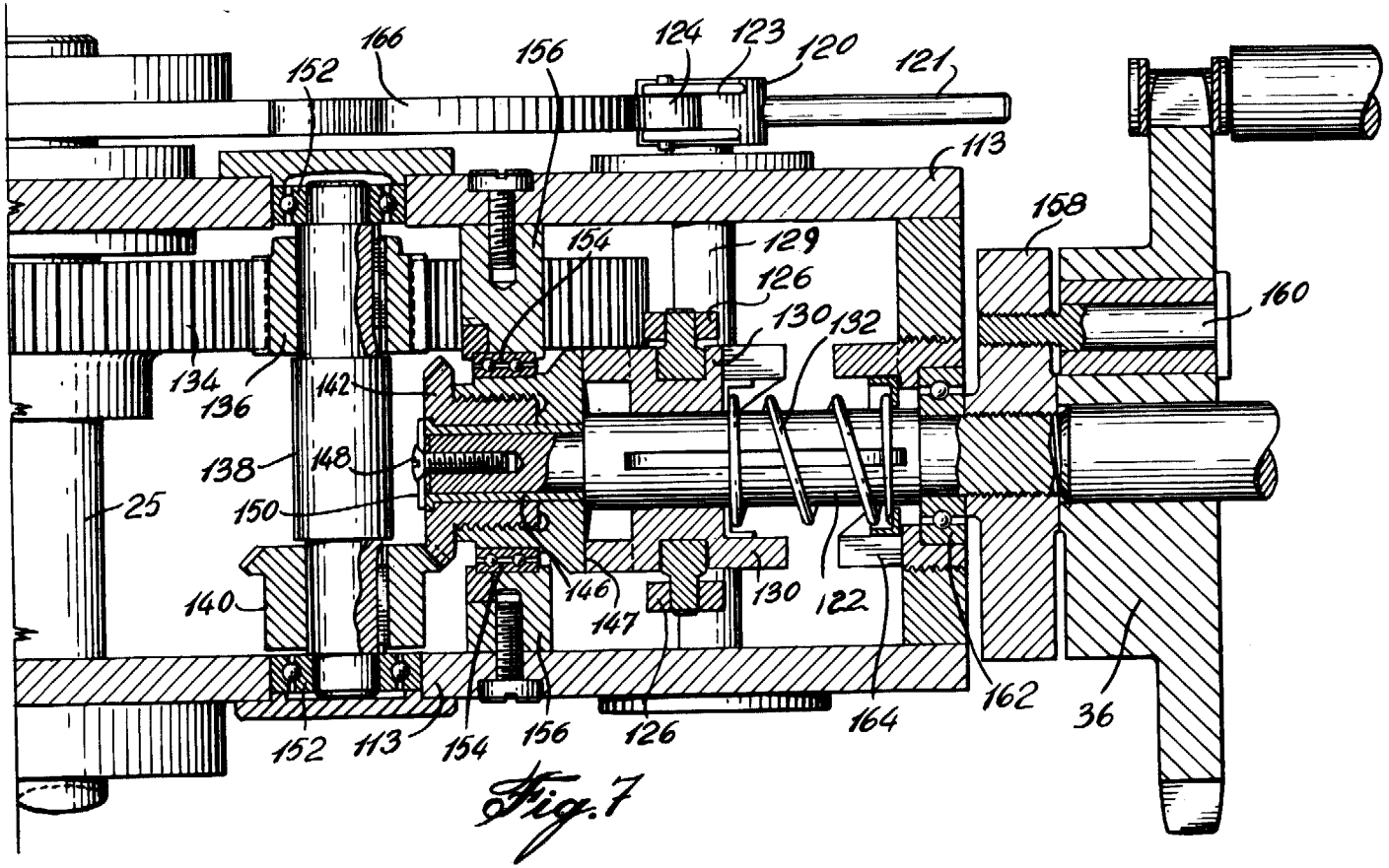
FIG. 7 is a vertical cross-section taken along line 7—7 of FIG. 5.
Figure 8:
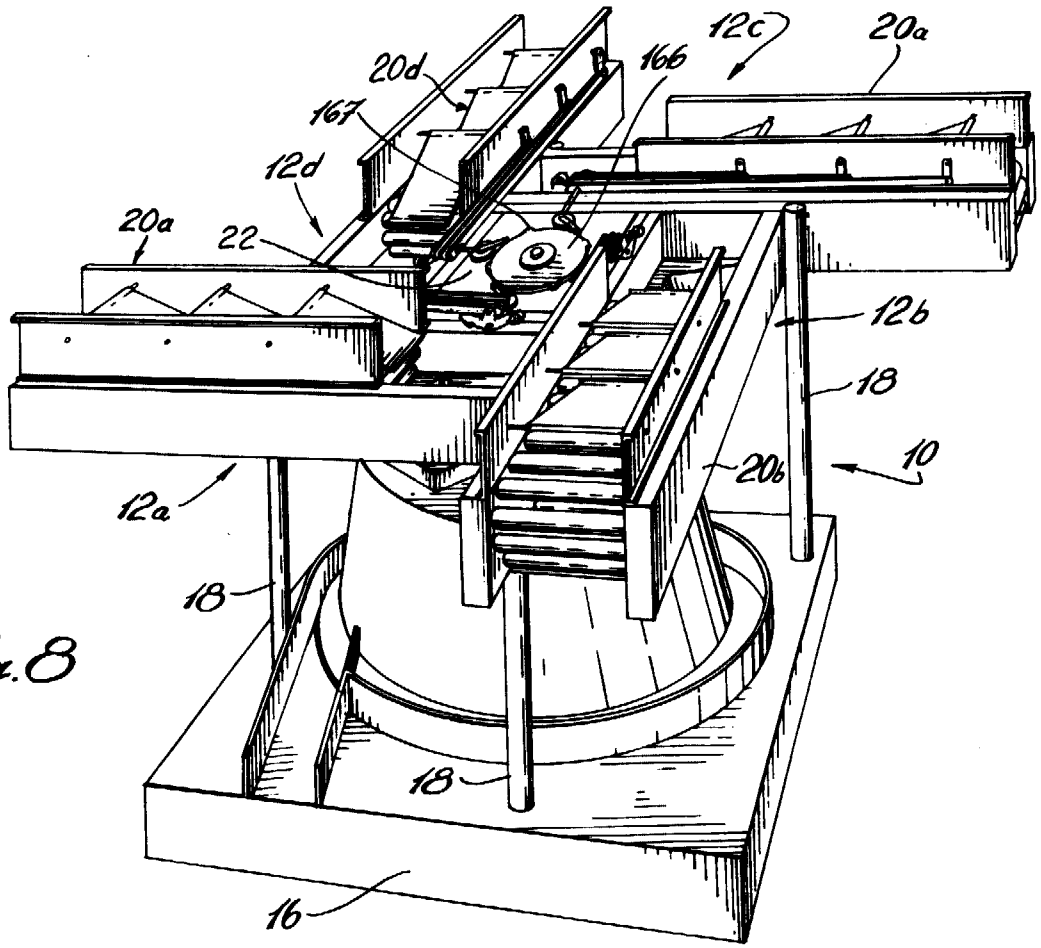
FIG. 8 is a perspective view of the apparatus in accordance with the present invention.

In looking at one single conveyor system 28, there is provided, as shown in FIG. 7, a clutch mechanism connecting the drive taken from the main shaft 25 to the sprocket 36. This clutch mechanism and drive include a gear 134 fixed to the shaft 25 and adapted to engage a gear 136 keyed to shaft 138 which in turn is journalled in ball bearings 152 at each end thereof connecting the shaft to the housing 113. The shaft 138 mounts a bevel gear 140 which in turn engages a bevel gear 142 adapted to rotate freely about the bearing sleeve 146 on the shaft 122. The bevel gear is journalled within the housing by means of support members 156 and ball bearings 154. The gear 142 is in turn fixedly connected to a claw member 147. A sliding clutch member 130, having complementary claws, is adapted to engage the claws of the member 147 under urging of spring 132. The sliding clutch 130 is keyed to shaft 122. Braking or stationary claws 164 are provided in the housing 113 for engaging and holding the clutch 132 as well as the shaft 122 when the clutch 130 is disengaged from the claws of member 147 whereby the member 147 is free to rotate about the shaft 122. In the position wherein the conveyor is at rest, the clutch will be engaged by the claws 164 and, therefore, the member 147 will rotate freely under the force transmitted to it by the drive shaft 25. However, the sprocket 36 connected to shaft 122 will not move.

The drive shaft 25 also mounts a large diameter cam wheel 166 having at least one cam projection 167 at each quadrant. Also mounted on the housing 113 is a bell crank member 120 connected to a shaft 129. The bell crank members 120 includes a finger 121 and an arm 123 mounting a cam follower roller 124. The finger 121 is adapted to be engaged by the hook shaped notch 118 in the arm 116 of a control lever 110. The control lever 110 is pivoted about the stub shaft 119 mounted to the frame, and it includes an arm 111 mounting a counterweight wheel 112, an arm 115 mounting the finger 114 adapted to be engaged in the notches 103, 105 and 107, and an arm 116 having a hook-shaped notch 118 adapted to engage the finger 121. The shaft 129 also has fixed thereto a fork 126 connected to the sliding clutch member 130 and adapted to move the clutch from an engaged position to a disengaged position.

In operation, as a predetermined number of pouches P accumulate on the roller type conveyor 20 which is in the rest position, the pouches lift and rotate the gates 96 and 98 and 100 counterclockwise sufficiently to move the bars 102, 104 and 106 successively in a direction Y as shown in FIG. 1. The notches 103, 105 and 107 are then in the position shown in FIG. 1 which would normally allow finger 114 to advance within the limits of the notches 103, 105 and 107. However, since the finger 121 of bell crank 120 is normally urged in a position engaging the hook 118, the control lever 110 will not normally rotate clockwise until the finger 121 is disengaged from the hook-shaped notch 118.

However, as the cam wheel 166 rotates, the projection 167 on the periphery thereof will cause the bell crank 120 to rotate counterclockwise, thereby disengaging slightly the finger 121 from the hook-shaped notch 118, allowing the control lever 110 to rotate clockwise under the urging of the counterweight 112. As the cam wheel continues to rotate in a counterclockwise direction, the cam follower 124 will be forced back to the periphery of the rim of the wheel. However, as the bell crank member 120 rotates clockwise under the urging of the spring 122, the finger 121 will pass the area of the hook-shaped notch 118 since the control lever has rotated upwardly. This will allow the bell crank 120 to continue its clockwise movement, thereby allowing the sliding clutch member 130 under the urging of spring 132 to engage the claws of member 147 which is continually rotating.

The sliding clutch member 130 will then cause the shaft 122 to immediately rotate and thus the sprocket 36, thereby immediately driving the conveyor chain.

At that time, the cam wheel 42 on shaft 35 which is rotated by shaft 34, will start its single revolution, allowing the member 52 to slide back under the urging of spring 53. Thus, the pins 66 can slide in the angle slots 64 of respective collars 58 and 60, moving the rods 72 and 74 inwardly, thereby causing the guide rails 80 and 81 to move inwardly. The movement of the guide rails 80 and 81 inwardly forces the rollers 87 and 89 of bell crank members 83 and 85 inwardly, thus causing the arms 83 and 85 to move inwardly on the plane of the conveyor. The arms 83 and 85 will lift between the pouches P thereby advancing them to discharge into a chute group 172.

Figure 6:
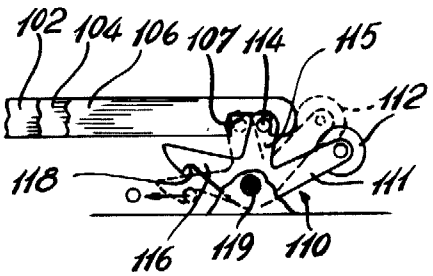
FIG. 6 is a fragmentary elevation of a detail thereof.

As soon as three pouches P have advanced and have been discharged, the gates 96, 98 and 100 will be forced downwardly in the clockwise direction, moving the bars 106 rearwardly in a direction X. This also causes the control lever 110 to rotate counterclockwise to a position shown in dotted lines in FIG. 6. In the meantime, as the wheel 166 continues to rotate in the counterclockwise direction, the cam follower 124 will engage the projection 167 of the next quadrant, forcing it to move counterclockwise, thereby causing the sliding clutch 130 to disengage itself from the member 147 and to engage the fixed member 164, thus stopping the conveyor. Simultaneously, the finger 121 of the bell crank member 120 will be moved in a counterclockwise direction and engage in the hook-shaped notch 118 of the now returned control lever 110, thereby locking it in that position preventing, therefore, the clutch from moving back into an engagement position with member 147 until all three bars 102, 104 and 106 have unlocked the finger 114 and thus the control lever 110. Obviously, in a situation where bags would be continuously advancing on the conveyor, the gates would stay in an open position, therefore keeping the bars 102, 104 and 106 advanced in the direction Y and preventing the control lever 110 from locking the finger 121. Thus, although the sliding clutch would be immediately disengaged when the cam projection pushes the roller 124, the finger 121 will not be locked and thus the clutch member 13 under urging 132 will slide back into engagement with member 147.

The chute assembly 22 includes a support wheel 170, and in this case, four different chute groups 172 with each chute group including three openings with vertical walls 176 and 178, each independent chute 180, 182 and 184 is adapted to receive one pouch from the feeding conveyor. The support wheel 170, of course, rotates at the same speed as the shaft 25 since it is fixed thereto and is coordinated through the clutch mechanism with the conveyor 20. As soon as three pouches have fallen into the chute group 172, the air switch 193 will activate a respective piston and cylinder arrangement 186, causing, as shown, the bottom wall 174 to pivot to open the bottom of the chute group 172. The pouches, of course, will fall simultaneously from the individual chutes 180, 182 and 184. In the meantime, an air jet 190 would have blown air into a waiting bag B on the bag storage rods 192, forcing the bag B to open to receive the pouches P falling from the chute 172. The weight of the puches P into the outer bag B will, of course, rip the bag from the storage pins 192 and the whole will fall on the rotating transfer means 196. The transfer means includes a tapered drum with a bottom flange. The conveyor will take off from the rotating transfer means from a point not shown.

On the shaft 25 just about the rotating transfer means 196, a cruciform support member 194 is provided with the projections **195*a*, 195*b*, 195*c* and 195*d*, extending outwardly towards each chute area. The support 195*a* acts as an abutment for downwardly pivoting bottom wall 174**.

I claim:

1. An apparatus comprising a frame, at least one feed conveyor for advancing liquid filled pouches, a rotary chute assembly having a plurality of chute groups with each chute group including a number of adjacent vertically extending chute sections corresponding to the number of pouches to be filled in a bag, each chute group including an outer bag holding station below the chute group, and means for opening said outer bag to receive a number of pouches from the particular chute group, each chute group in a bag holding assembly being adapted to rotate about a circular locus passing under the discharge of the feed conveyor, and cooperating means causing the feed conveyor to advance when there is a predetermined number of pouches on the feed conveyor and there is a chute group passing below the discharge of the feed conveyor so as to receive a number of pouches being fed by the feed conveyor.

2. An apparatus as defined in claim 1, wherein each feed conveyor includes a discharge end and an entry end, the conveyor including pouch accumulating means at the discharge end when the conveyor is stopped such that pouches can be accumulated thereon, means on the conveyor for allowing pouches to advance to the pouch accumulating means, signal means for advancing the conveyor means when a predetermined number of pouches is accumulated thereon and when a chute group on the rotary member is approaching the discharge end of the conveyor such that the conveyor will advance the pouches to fall in respective chute sections of each chute group.

3. An apparatus as defined in claim 2, wherein the conveyor includes an endless chain means having freely rotating rollers thereon, and a plurality of upwardly pivoting arm members pivotably mounted to the chain conveyor and spaced apart from each other longitudinally of the conveyor the distance of a pouch length, means for holding the arms below the plane of the conveyor when the conveyor is at rest with the exception of the arms at the discharge end to allow accumulation of the pouches on the conveyor, means for projecting the arms upward when the conveyor is starting to move between each accumulated pouch to advance the pouches towards discharge into a chute section of each chute group.

4. An apparatus as defined in claim 3, wherein the means for pivoting the arms out of the plane of the conveyor to project between the pouches includes a pair of movable, parallel, spaced-apart rails adapted to move to and from each other, each arm including a bell crank with a counterweight roller mounted on the bell crank and engaging one of the rails, such that as the rails are moved towards each other, the arm of the bell crank pivots above the level of the conveyor.

5. An apparatus as defined in claim 3, wherein at least four conveyor feed means extend tangentially of the rotary chute assembly.

6. An apparatus as defined in claim 3, wherein there is provided a main drive shaft centrally of the apparatus to which is mounted the rotary chute assembly, gear means and a clutch assembly is provided between the main shaft and the drive shaft for said conveyor, and control means are provided for engaging the drive shaft to said conveyor shaft by way of said clutch.

7. An apparatus as defined in claim 6, wherein the control means for connecting the drive from said main shaft to said conveyor drive includes a rotary cam wheel mounted to said shaft, at least a cam projection for each conveyor included in the apparatus, a bell crank lever with cam follower adapted to follow said cam wheel provided for each conveyor and including means for operating said clutch, a plurality of gate means provided on the conveyor, one for each pouch of a predetermined number of pouches to be discharged, an accumulative control means whereby when a predetermined number of pouches are accumulated on the conveyor, the corresponding predetermined number of gates are activated to allow the control means to engage said clutch for driving the conveyor as the cam projection on the cam wheel corresponding to the position of the chute group on the chute assembly engages the control means.

* * * * *